United States Patent [19]

Carter

[11] Patent Number: 4,793,037

[45] Date of Patent: Dec. 27, 1988

[54] METHOD OF MAKING A BULLET

[76] Inventor: Herman L. Carter, P.O. Box 262348, Houston, Tex. 77207

[21] Appl. No.: 11,582

[22] Filed: Feb. 6, 1987

[51] Int. Cl.[4] ..... B21K 21/06

[52] U.S. Cl. ..... 29/1.23; 29/527.5; 102/507

[58] Field of Search ..... 29/1.2, 1.22, 1.23, 29/530, 527.1, 527.5; 102/507, 516; 72/46

[56] References Cited

U.S. PATENT DOCUMENTS

| | | | |
|---|---|---|---|
| 1,114,205 | 10/1914 | Watkins | 102/507 |
| 1,172,035 | 2/1916 | Newton | 102/507 |
| 1,833,127 | 11/1931 | Rinkel | 102/507 |
| 2,958,287 | 11/1960 | Auxier | 102/507 |
| 4,610,061 | 9/1986 | Halverson | 29/1.23 |
| 4,660,263 | 4/1987 | Kosteck | 29/1.23 |

*Primary Examiner*—P. W. Echols
*Assistant Examiner*—Irene Cuda
*Attorney, Agent, or Firm*—Vaden, Eickenroht, Thompson & Boulware

[57] ABSTRACT

A bullet and method of making the bullet is disclosed. The bullet comprises an outer jacket of copper base material and an inner core of lead. The jacket includes a base portion and an ogive shaped cylindrical portion. The base portion has a higher yield point than the cylindrical portion so that the base portion will remain intact after impact with a game animal while the cylindrical section splits longitudinally and expands as the bullet travels into the target with a minimum in weight reduction. The method of making the bullet includes work hardening the base portion more than the cylindrical portion to obtain the higher yield strength.

2 Claims, 1 Drawing Sheet

FIG.1
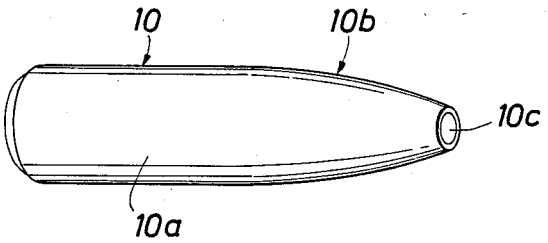
FIG. 2
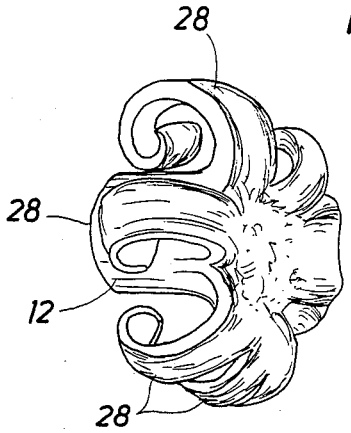
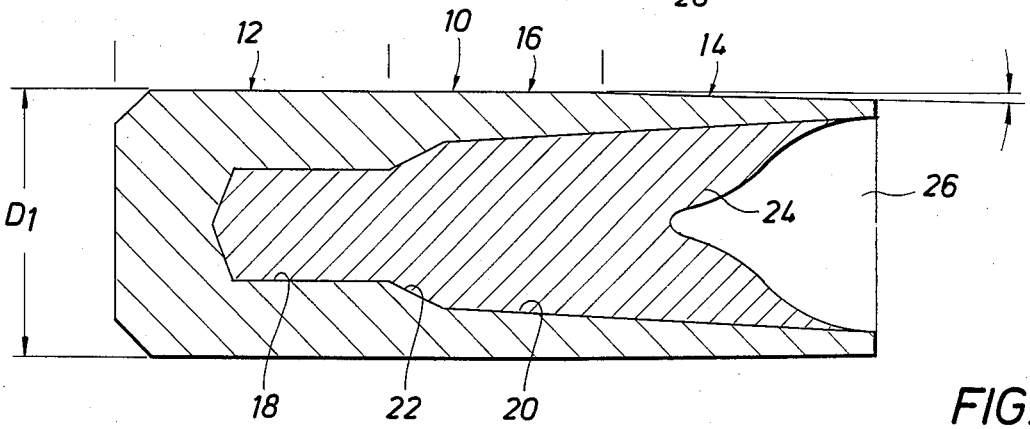
FIG. 3
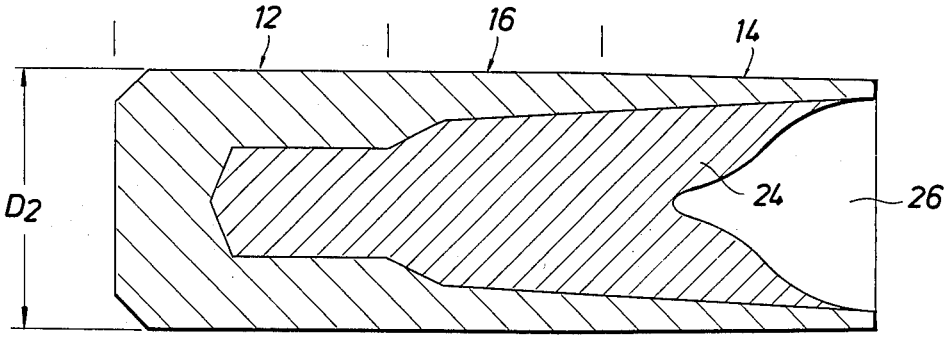
FIG. 4
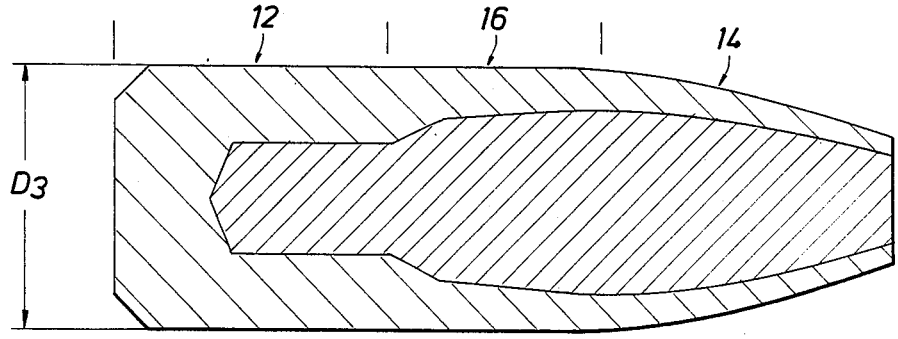
FIG. 5

METHOD OF MAKING A BULLET

This invention relates to bullets generally and, in particular, to bullets of the bonded core soft nose type used for hunting game, particularly large game animals ranging from deer to elephants.

Soft nose bullets are expected to expand in diameter as they penetrate game animals. The bullets have an outer jacket of a copper base material that may be pure copper or a copper alloy such as brass, and an inner core of lead. It is the peeling back or mushrooming of the outer jacket when the bullet strikes a game animal that produces the increase in diameter. It is important that the bullet expand in diameter, but it is also important that the bullet retain as much of its original weight as possible. Some bullets of this type can lose as much as 40%, 45%, or more of its total weight during the initial 4" to 8" of penetration which greatly reduces its effectiveness. For example, a 200 grain 0.308 bullet that loses 50% of its weight turns into a low velocity 100 grain 0.243 class bullet during the balance of its penetration of a game animal and its effectiveness is greatly reduced. Much of the weight loss is attributed to the loss of lead as the jacket peels backwardly, but a lot of the weight loss is due to the breaking off of the sections of jacket that peel back toward the rear of the bullet. By bonding the lead to the jacket, the lead loss can be reduced, but there is still a problem with the breaking off of the jacket sections that peel back as the bullet penetrates a game animal.

It is an object of this invention to provide a soft nose, bonded core bullet that consistently retains 90% or more of its weight with practically no loss of the peeled back sections of the jacket.

The peeled back sections are usually called "cutting claws". Big game bullets spin at between 108,000 to 223,000 revolutions per minute. The spinning cutting claws create a more lethal and humane bullet due to their sharp cutting edges, if they remain attached to the base of the bullet.

It is another object of this invention to provide a method of making a soft nose, bonded core bullet that has an outer jacket that increases in hardness, and therefore yield strength, from the soft nose rearwardly toward the base of the bullet. This results in a much higher percentage of retention of the cutting claws.

It is a further object of this invention to provide a method of making a bullet having increased hardness and yield strength from the nose to the base that includes work hardening the copper base jacket between the nose and the base of the bullet in varying amounts as the jacket is formed into the desired shape and caliber.

It is a further object of this invention to provide such a bullet and a method of making the same that includes machining the outer jacket to form a generally cylindrically-shaped solid base jacket out of copper base materials placing a predetermined amount of lead in the jacket, heating the jacket to a temperature sufficient to melt the lead and cause it to bond to the inner surface of the jacket and at the same time annealing the entire jacket to remove any stresses created in the jacket during the machining of the jacket, drawing the base of the jacket to a diameter less than the desired caliber to both harden the base material add to increase its yield strength placing the drawn jacket with the bonded core material in a die, and forming the bullet to the desired shape at the same time expanding the base of the jacket to the desired caliber thereby adding further work hardening to the material of the base while forming the nose of the bullet to the desired to give design.

These and other objects, advantages, and features of this invention will be obvious to those skilled in the art from a consideration of this specification including the attached drawings and appended claims.

IN THE DRAWINGS

FIG. 1 is an isometric view of a typical soft nose bonded core bullet of the type to which this invention relates.

FIG. 2 is an isometric view of a typical bullet of this invention after it has been recovered from a game animal showing how the forward part of the jacket splits longitudinally, generally along the grooves formed by the lands of the rifle as the bullet penetrates the animal, and curls backwardly over the base of the bullet to form cutting claws having very sharp edges to increase the lethal effect of the bullet while remaining attached to the base to retain substantially the original weight of the bullet as it penetrates the animals.

FIGS. 3, 4, and 5 illustrate the steps of the method of this invention that produces a bullet having the desirable features described above.

Bullet 10 in FIG. 1 has the typical shape of a soft nose, bonded core bullet. The outer jacket includes section 10*a* that is of the diameter required for the particular caliber of bullet and a tapered nose 10*b* that ay be tapered along an ogive curve. The end of lead core 10*c* can be seen through the open end of the jacket.

FIG. 3 of the drawing shows the condition of the bullet after the first three steps of the method of making the bullet of this invention have been performed. The first step is to form the outer jacket from a copper base material, such as machining the jacket from a solid rod of copper or brass. The jacket includes base portion 12 at one end and tapered cylindrical portion 14 at the other end. Connecting these two sections is transition portion 16. Base portion 12 is solid except for small diameter bore 18. For purposes of strength, it would be preferred to have the base made out of solid copper base material, but since lead weighs three times as much as copper and it is important that the bullet have as great a mass as possible, bore 18 is provided to allow part of the base to be filled with lead. The wall between the bore and the outer surface of the base, however, is sufficiently thick for the base to retain its shape upon impact with a game animal.

Bore 20 of the jacket extends from the front of the jacket through cylindrical section 14 and partway through transition section 16. Bore 20 is of decreasing diameter as it progresses toward the base so that the wall of the jacket decreases in width from where bore 20 ends in the transition section to the open end of the bore. The outer surface of cylindrical section 14 is also tapered further decreasing the width of the wall toward the end of the jacket. Bore 20 is connected to bore 18 by a short steeply inclined bore 22.

The outer diameter, D1, of the base is larger than what the final diameter will be by an amount calculated to cause the metal of the base and the transition portion of the jacket to be work hardened sufficiently when formed to the proper caliber to have sufficient yield strength to resist deformation upon impact with a game animal.

After the jacket has been formed in this manner, the proper amount of lead 24 is placed in the bore of the jacket. The jacket and the lead are then heated to a temperature sufficient to melt the lead and cause it t bond to the inner surface of the jacket. This also anneals the jacket and removes any stresses created in the jacket while it was being formed. As the jacket and lead cool, the lead will solidify and form shrink cavity 26 adjacent the open end of the jacket.

Next, the outer diameter of the jacket is drawn to diameter D2. This step work hardens the metal in base portion 12. It also work hardens the metal in transition portion 16 but to a lesser extent because of the smaller amount of metal involved. Diameter D2 is sufficiently smaller than the final diameter D3 to allow the jacket to be slid easily into the forming die that will give the bullet its final shape.

Thus, the next and last step in the method of manufacturing the bullet of this invention is to place the bullet, as shown in FIG. 4 in a forming die and force cylindrical portion 14 into the curved shape shown in FIG. 5. In the same operation, the outer diameter of intermediate portion 16 and base portion 12 will be expanded to that of the caliber of the bullet being manufactured. This further work hardens and strengthens these portions of the jacket. Cylindrical portion 14 will also be work hardened to some extent as its outer walls are forced into the shape shown in FIG. 5. This work hardening will be very slight compared to the work hardening that occurs in the base. The work hardening of transition portion 16 will be less than that of the base, but more than that of cylindrical portion 14.

Consequently, a bullet is produced having an outer jacket that is made out of progressively harder and higher yield material, the hardness and yield strength of which increase from the nose to the base. As a result, when the bullet strikes and begins penetrating a game animal, the cylindrical portion 14 will be split longitudinally due to the forces resisting the forward movement of the bullet and peel or curl backwardly toward base portion 12, as shown in FIG. 2, forming a plurality of cutting claws 28. The distance the jacket splits will be limited by the increasing toughness and higher yield strength of the work hardened material toward the base of the bullet. Further, with the increased yield strength of the material toward the rear of the bullet, the tendency of the cutting claws to break off and be lost is substantially eliminated, allowing the bullet to maintain substantially its original weight.

From the foregoing it will be seen that this invention is one well adapted to attain all of the ends and objects hereinabove set forth, together with other advantages which are obvious and which are inherent to the method.

It will be understood that certain features and subcombinations are of utility and may be employed without reference to other features and subcombinations. This is contemplated by and is within the scope of the claims.

Because many possible embodiments may be made of the invention without departing from the scope thereof, it is to be understood that all matter herein set forth or shown in the accompanying drawings is to be interpreted as illustrative and not in a limiting sense.

What is claimed is:

1. A method of making a bullet having an outer jacket of copper base material and an inner core of lead, said jacket including a base portion, an ogive-shaped cylindrical portion, the walls of which decrease in thickness away from the base portion, and a transition portion between the base portion and the cylindrical portion, said base portion having a solid section and a cylindrical section with walls substantially thicker than those of the ogive-shaped cylindrical portion, said method comprising the steps of machining the outer jacket from a rod of copper base material with the base portion and the transition portion having an initial outside diameter greater than the desired caliber and the walls of the cylindrical portion being tapered inwardly, placing a predetermined amount of lead in the jacket, heating the jacket to melt the lead to cause the lead to bond to the inside surface of the jacket and to anneal the jacket to increase its ductility and reduce its hardness, drawing the outside diameter of the jacket to a diameter slightly less than the desired caliber to increase the tensile strength and hardness of the base portion of the jacket and to increase the tensile strength and hardness of the transition portion to a lesser extent, and forming the cylindrical portion into the desired ogive design while increasing the diameter of the base portion and the transition portion to the desired caliber to provide a bullet having a work hardened base portion that will remain intact after impact, a cylindrical portion that is slightly work hardened by the forming operation and a transition portion that is work hardened more than the cylindrical portion but less than the base portion so that the cylindrical portion and at least part of the transition portion will split longitudinal into several sections that curl outwardly while remaining attached to and carried by the base to reduce the weight loss of the bullet to a minimum as it penetrates a target.

2. A method of making a solid base bullet comprising the steps of forming an outer jacket of copper base material with a base portion of a diameter larger than the desired caliber of the bullet and a cylindrical portion having an open end and walls that taper inwardly toward the open end of the cylinder, placing the desired amount of lead base metal in the jacket, heating the jacket to bond the lead base metal to the jacket and to anneal the jacket, forming the jacket to the outside diameter of the desired caliber and the walls of the cylindrical portion into the desire shape to increase the hardness and tensile strength of the base portion of the jacket and to a lesser degree the cylindrical portion, said forming ste including, the steps of drawing the base portion to a diameter smaller than the desired caliber and expanding the base portion to the desired caliber as the walls of the cylinder portion are formed to the desired shape.

* * * * *